US006434835B1

(12) United States Patent
Grunikiewicz et al.

(10) Patent No.: US 6,434,835 B1
(45) **Date of Patent: *Aug. 20, 2002**

(54) CUTTING KNIFE FOR CUTTING THROUGH ADHESIVE BEADS ON GLASS PANES OF VEHICLES

(75) Inventors: Peter Grunikiewicz; Bert G. Wurst, both of Stuttgart (DE)

(73) Assignee: C. & E. Fein GmbH & Co. (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/441,478

(22) Filed: Nov. 17, 1999

(30) Foreign Application Priority Data

Nov. 17, 1998 (DE) ..... 198 52 810

(51) Int. Cl.[7] ..... B26B 9/02; B26B 7/00
(52) U.S. Cl. ..... 30/272.1; 30/277.4
(58) Field of Search ..... 30/272.1, 123, 30/277, 315, 220, 277.4; 29/275; 403/343

(56) References Cited

U.S. PATENT DOCUMENTS 2,681,502 A * 6/1954 Black ..... 30/2
3,448,517 A * 6/1969 Cothery ..... 30/140
3,924,327 A * 12/1975 Edwards ..... 30/277
4,080,734 A * 3/1978 Barbour ..... 30/277
4,215,475 A * 8/1980 Morford et al. ..... 30/277
4,300,287 A * 11/1981 Tibbs ..... 30/277
4,432,138 A * 2/1984 Piccolo, Jr. ..... 30/294
4,543,720 A 10/1985 Grunikiewicz et al.
4,587,733 A * 5/1986 Staempfli ..... 30/277
4,700,478 A * 10/1987 Mezger et al. ..... 30/294
4,980,976 A 1/1991 Junginger et al.

FOREIGN PATENT DOCUMENTS

DE 33 24 676 C1 10/1984
EP 0 141 035 A1 7/1984
EP 0369 390 A2 5/1990

* cited by examiner

*Primary Examiner*—Douglas D. Watts
(74) *Attorney, Agent, or Firm*—St. Onge Steward Johnston & Reens LLC

(57) ABSTRACT

The invention describes a cutting knife for a cutting tool for cutting through adhesive beads on glass panes of vehicles, having a cross section that is bent into a U-shape and comprises a first limb, configured as the attachment part, with a receiving opening for attachment to an oscillating drive, and a second limb that is configured as the cutting part and is joined via an intermediate part to the attachment part of the cutting knife, the intermediate part and the cutting part being shaped such that a distance exists in the radial direction between the center point of the receiving opening and at least one cutting edge. The cutting part has, in a middle region between its outer free end and its angled transition to the intermediate part, a lesser width than at the transition and at the outer end. This results in a reduced susceptibility to breakage.

9 Claims, 1 Drawing Sheet

CUTTING KNIFE FOR CUTTING THROUGH ADHESIVE BEADS ON GLASS PANES OF VEHICLES

BACKGROUND OF THE INVENTION

The present invention relates to a cutting knife for a cutting tool for cutting through adhesive beads on glass panes in particular on vehicles, having a cross section that is bent into a U-shape and comprises a first limb with a receiving opening for attachment to an oscillating drive, and a second limb that is configured as the cutting part and is joined via an intermediate part to the first limb of the cutting knife, the intermediate part and the second limb being shaped such that a distance exists in the radial direction between the center point of the receiving opening and at least one cutting edge.

Cutting knives of this kind bent into a U-shape are known, for example, from German patent 3,324,676 and from U.S. Pat. No. 4,543,720: the former discloses a cutting part, curved in a sickle shape, that faces away from the receiving opening; and the latter discloses a cutting part, curved in a sickle shape, that faces toward the receiving opening. Also known from U.S. Pat. No. 4,980,976 is a cutting knife, bent into a U-shape, whose cutting part is straight.

A characteristic shared by the known cutting knives is that when cutting through adhesive beads, for example to remove a damaged motor vehicle windshield, there is a considerable risk of breakage for the cutting knife.

The reason for this is on the one hand the tough material of the adhesive bead, usually made of a specific type of polyurethane, and on the other hand the energy expenditure—which in some cases can be quite substantial despite the drive system that oscillates at high frequency and with a small pivot angle—especially when cutting through wider adhesive beads, such as often occur in particular in the case of windshields that have already been replaced once, so that the adhesive bead had to be applied manually when installing the windshield.

An increased risk of breakage exists in particular in the case of cutting knives that, because of the geometry of the motor vehicle in question, must have a relatively long cutting part; this is also specifically the case for a cutting knife having a straight cutting part, as defined in U.S. Pat. No. 4,980,976, which makes possible particularly long straight cutting parts.

It is therefore an object of the invention to improve a cutting knife of the kind cited initially in such a way that the susceptibility to breakage is reduced. It is a further object of the invention to disclose a cutting knife which allows to reduce the energy expenditure necessary for cutting through an adhesive bead.

SUMMARY OF THE INVENTION

According to the present invention these and other objects are achieved, in the case of a cutting knife of the kind cited initially, in that the second limb has, in a middle region between its outer free end and its angled transition to the intermediate part, a smaller width than at the transition and at the outer end.

The object of the invention is completely achieved in this fashion.

Specifically, it was recognized in the course of the invention that in the previously known cutting knives, the risk of breakage is greatest at the transition from the cutting part to the intermediate part. On the other hand, the risk of breakage cannot be eliminated simply by widening the cutting part at the transition to the intermediate part. The reason is that too wide a cutting part results in greatly increased friction between the cutting part and the portion of the adhesive bead that has already been cut through, and thus in a greatly increased energy expenditure when working.

With the configuration of the cutting knife according to the present invention, on the one hand the risk of breakage is improved because of the enhanced stability due to the widening of the cutting part at its transition to the intermediate part; the subsequent constriction of the cutting part toward the outside reduces the force necessary to cut through the adhesive bead. In addition, the fact that the cutting part widens again toward its outer end results in greatly improved centering of the cutting part during the cutting operation, which yields not only better guidance but also reduced energy expenditure.

What is moreover taken advantage of here is the fact that because of the specific geometry between the vehicle's glass pane and body flange, a certain distance usually exists, while working, between the spacing plate and the adhesive bead being cut through, so that a wider configuration of the cutting part at its end facing toward the spacing plate results in almost no increase in energy expenditure.

According to a development of the invention, the cutting part has a first cutting edge that faces toward the receiving opening and is concavely curved with respect thereto, and a second cutting edge that faces away from the receiving opening and is convexly curved with respect thereto.

This feature makes possible improved centering and guidance of the cutting knife while working, both when the cutting knife is pulled toward the receiving opening while working, and also when the cutting knife needs to be guided back in an opposite direction in the portion of the adhesive bead that has already been cut through.

According to the further embodiment of the invention, the cutting part has a first cutting edge that faces toward the receiving opening and is concavely curved with respect thereto, and a second cutting edge that is straight or slightly convexly curved and faces away from the receiving opening.

An embodiment of this kind is advantageous particularly if work is to be performed with the cutting knife only in one preferred direction, namely toward the receiving opening. Stability is further improved by the fact that the cutting part is then somewhat wider overall.

According to a further feature of the invention, the cutting part has a first cutting edge that faces toward the receiving opening and is straight or is slightly convexly curved, and a second cutting edge that faces away from the receiving opening and is convexly curved with respect thereto.

This kind of embodiment of the cutting knife is advantageous in particular when, because of the particular geometry on certain motor vehicles, the principal working direction does not, as in the case of the two embodiments cited above, extend from the cutting part toward the receiving opening, (i.e. the knife is not, so to speak, pulled through the adhesive bead), but rather the cutting knife must be guided in the opposite direction, i.e. in a manner of speaking must be pushed through the adhesive bead. Because the cutting edge is then concavely curved toward the advance direction, the cutting operation is in turn facilitated by the scything effect, while the susceptibility to breakage is reduced by the overall somewhat wider configuration of the entire cutting part.

According to a further feature of the invention, the cutting part has a tip at its outer end.

This feature makes it easier to insert the cutting part through the adhesive bead.

According to a further feature of the invention, the cutting part is shaped so that the radial distance to the center point of the receiving opening increases from the transition out toward the outer end.

This geometry, which in other words moves the cutting part farther toward the outer end away from the center point of the receiving opening, results in greater deflection of the cutting part by the linear stroke of the oscillating drive itself. This reduces the muscle force to be applied by the user when cutting through an adhesive bead, since the linear stroke of the oscillating drive itself is utilized to a greater extent.

It is understood that the features of the invention mentioned above and those yet to be explained below can be used not only in the respective combinations indicated, but also in other combinations or in isolation, without leaving the context of the invention.

SHORT DESCRIPTION OF THE DRAWINGS

Further features and advantages of the invention are evident from the description below of preferred exemplary embodiments with reference to the drawings, in which.

DETAILED DESCRIPTION OF THE PREFERRED EMBODIMENTS

Figure 1:
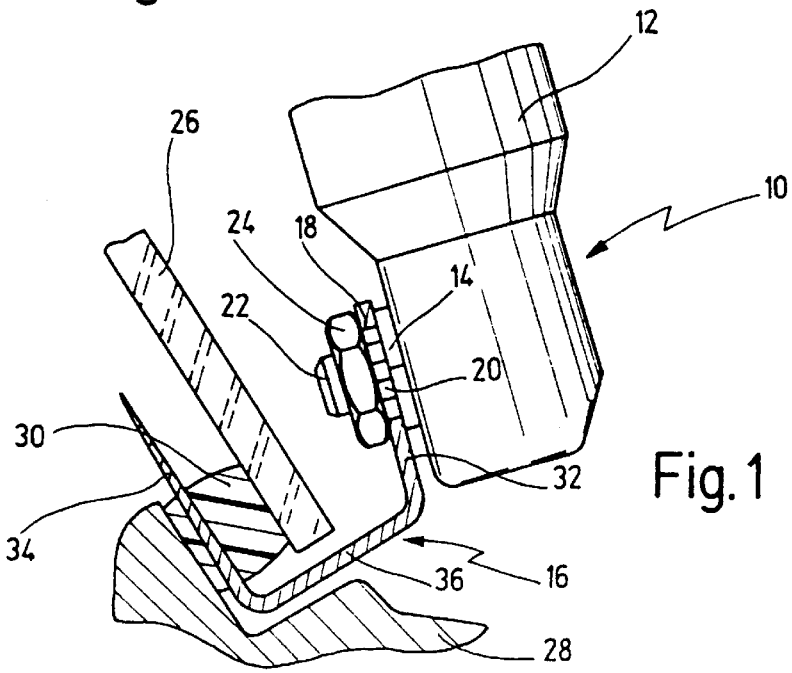
FIG. 1 shows a sectioned representation of a cutting knife according to the present invention, being used with an oscillating drive.

In FIG. 1, a cutting tool according to the present invention is shown in its entirety with the number 10.

Cutting tool 10 comprises an oscillating drive 12 whose drive shaft 14 can be driven in oscillating fashion at high frequency (in the range between approximately 5,000 and 25,000 vibrations per minutes), and with a small pivot angle (in the range between approximately 0.5° and 5°). On drive shaft 14, a cutting knife labeled in its entirety with the number 16 is received with a receiving opening 18 on a polygonal member 20 of drive shaft 14, and attached with a nut 24 onto threads 22 of drive shaft 14.

Figure 2:
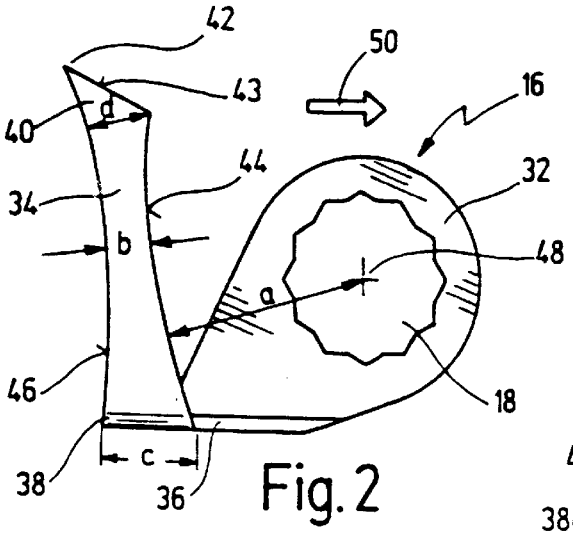
FIG. 2 shows a view of a first embodiment of a cutting knife according to the present invention in a representation enlarged somewhat by comparison with FIG. 1.
Figure 3:
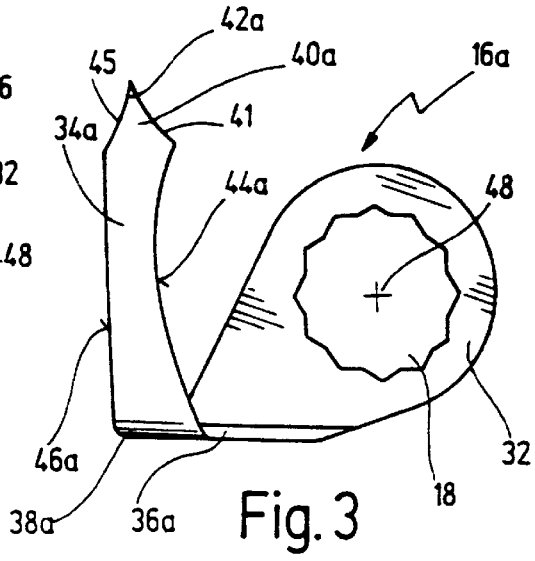
FIG. 3 shows a view of an embodiment, modified as compared to FIG. 2, of a cutting knife according to the present invention.
Figure 4:
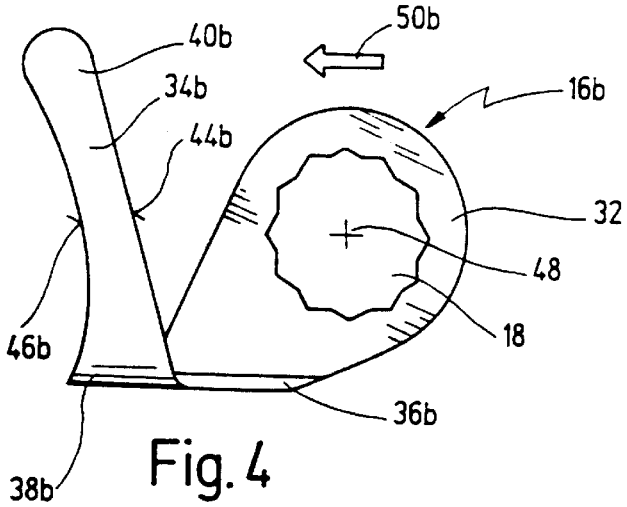
FIG. 4 shows a view of a further modification of a cutting knife according to the present invention.

Cutting knife 16 is bent approximately into a U-shape in cross section and has a first limb, configured as attachment part 32, in which receiving opening 18 is configured in the form of a dodecagon whose shape is evident from FIGS. 2 through 4. Attachment part 32 is joined via an intermediate part 36 to a second outer limb that is configured as cutting part 34. While spacing plate 36 and cutting part 34 form an angle of approximately 90° to one another, attachment part 32 forms with intermediate part 36 an angle that is somewhat greater than 90° and preferably lies in the range between approximately 93° and 110°. As a result, oscillating drive 12 can be held angled slightly outward while working.

Cutting tool 10 is used to cut through an adhesive bead 30 of a glass pane 26 that is adhesively bonded onto a body flange 28 on a motor vehicle. This can be, for example, a windshield that is joined and adhesively bonded in completely sealing fashion onto the A-pillar of the body by way of the surrounding adhesive bead 30. This adhesive bead 30 is usually made of a special polyurethane that exhibits the greatest possible UV resistance and a high level of mechanical and long-term stability. As a result of this adhesive bonding of the windshield to the A-pillar, the windshield contributes substantially to the stability of the body. It is therefore understandable that the adhesive bead is made of a material that is so tough and stable that completely cutting through it in order to remove the windshield, for example after stone impact damage, is associated with a considerable energy expenditure, even when the advantageous effect of oscillating drive 12 is taken into account.

For this reason, numerous cutting knife variants (explained above) have already been developed.

Because of the high mechanical load on cutting knife 16 during the removal operation, however, failures have repeatedly occurred because cutting part 34 often broke off in the region of its transition to spacing plate 36.

The cutting knife according to the present invention offers enhanced stability particularly in this region, since as shown in FIG. 2, its width c in the region of transition 38 to spacer plate 36 is greater than width b in the middle region of cutting part 34, cutting part 34 in turn possessing an enlarged width d at its outer end 40.

The result of this configuration, in addition to the improved stability in the region of transition 38, is an improved cutting effect and centering during the cutting operation.

In the embodiment of cutting knife 36 as shown in FIG. 2, cutting part 34 has a first cutting edge 44, facing toward receiving opening 18, that is concavely curved with respect to receiving opening 18; and a second cutting edge 46, on the opposite side facing away from receiving opening 18, that is convexly curved with respect to receiving opening 18.

Cutting part 34 has at its outer end 40 a tip 42 that is constituted by a straight edge 43 running obliquely outward from first cutting edge 44 to second cutting edge 46.

Cutting knife 16 thus has the overall shape of a tomahawk. Tip 42 facilitates insertion of the cutting knife through adhesive bead 30 at the beginning of the removal operation.

Because of the concave shape of first cutting edge 44 with respect to receiving opening 18 it is advantageously possible, when working in the principal working direction 50—in which cutting knife 16 on oscillating drive 12 is, to a certain extent, pulled through adhesive bead 30—to exploit the so-called scything effect, which causes cutting knife 16 gradually to cut into adhesive bead 30 during the oscillating movement; this allows smooth operation and at the same time decreases the susceptibility to breakage. This effect is additionally promoted by the fact that distance a between first cutting edge 44 and center point 48 of receiving opening 18 gradually increases from transition 38 out toward outer end 40.

Because second cutting edge 46 is convexly curved with respect to receiving opening 18, centering on the material being cut is possible even when the cutting edge must be guided against principal working direction 50 in the opposite direction; this may occur, for example, at the beginning of the removal operation or when working in a corner. While working in principal working direction 50, blade 44 is centered on adhesive bead 30 because of its concave shape.

FIG. 3 shows a shape of a cutting knife according to the present invention that is slightly modified by comparison with FIG. 2 and is labeled in its entirety with the number

16*a*. Corresponding reference numbers are used for corresponding parts.

Cutting part 34*a* has on its side facing toward attachment opening 18 a first cutting edge 44*a*, also concavely curved, and possesses on its opposite side a straight cutting edge 46*a*.

Constituted at its outer end 42*a* is once again a tip 42*a*, now constituted by two outer edge segments 41, 45 that come together at tip 42*a* from first cutting edge 44*a* and from second cutting edge 46*a*.

Because width b is also somewhat increased overall in the middle region between transition 38*a* and outer end 40*a*, cutting part 34*a* possesses overall, as compared to the embodiment shown in FIG. 2, a somewhat enhanced stability as compared to the embodiment according to FIG. 2.

A further modification of a cutting knife according to the present invention is shown in FIG. 4 and labeled in its entirety with the number 16*b*.

Once again, corresponding reference numbers are used for corresponding parts.

Cutting part 34*b* has on its side facing toward attachment opening 18 a straight cutting edge 44*b*, and possesses on its opposite side a second cutting edge 46*b* that is convexly curved with respect to receiving opening 18. In contrast to the embodiments shown in FIGS. 2 and 3, what is constituted at its outer end 40*b* is not a tip but a rounded outer edge.

The embodiment shown in FIG. 4 is preferably designed for working in a direction 50*b* that is opposite to principal working direction 50 as defined by the embodiments in FIGS. 2 and 3.

In this embodiment, cutting knife 16*b* is therefore not pulled through the material being cut, but rather is pushed through adhesive bead 30 with the aid of oscillating drive 12.

In all the embodiments, the cutting knife is guided while working by the fact that intermediate part 36, 36*a*, 36*b* is guided along body flange 28. It is thereby. possible in most cases to prevent any damage to the glass pane during the removal operation, in cases where a glass pane needs to be reattached adhesively simply because it has become leaky.

What is claimed is:

1. A cutting knife for cutting tools for cutting through adhesive beads on glass panes, said cutting knife being of angular U-shaped configuration and comprising:

an attachment part having a receiving opening for attachment to a drive shaft of an oscillating drive and forming a first U-leg;

an intermediate part adjoining said attachment part and forming a central U-leg;

a cutting part forming a second U-leg, said cutting part adjoining said intermediate part at a first end, said cutting part extending from said first end outwardly to a second free end and forming a middle region therebetween, said cutting part having a first cutting edge facing toward said receiving opening and a second cutting edge facing away from said receiving opening, a distance between said cutting edges varying from a first width being defined proximate to said first end, a second width being defined within said middle region, and a third width being defined proximate to said second end, said first and third widths exceeding said second width;

at least one of said cutting edges having an inwardly curved contour for centering the bead on said at least one of said cutting edges and for reducing energy expenditure; and said cutting part being displaced radially with respect to a center point of said receiving opening.

2. The cutting knife as defined in claim 1, wherein said first cutting edge is concavely curved with respect to said receiving opening, and wherein said second cutting edge is convexly curved with respect to said receiving opening.

3. The cutting knife as defined in claim 2, wherein at least one of said cutting edges has a radial distance to the center point of said receiving opening which increases from said first end toward said second end.

4. The cutting knife as defined in claim 1, wherein said first cutting edge is concavely curved with respect to said receiving opening, and said second cutting edge is straight and faces away from said receiving opening.

5. The cutting knife as defined in claim 4, wherein at least one of said cutting edges has a radial distance to the center point of said receiving opening which increases from said first end toward said second end.

6. The cutting knife as defined in claim 2, wherein at least one of said cutting edges has a radial distance to the center point of said receiving opening which increases from said first end toward said second end.

7. The cutting knife as defined in claim 1, wherein said first cutting edge is of straight configuration, and wherein said second cutting edge is convexly curved with respect to said receiving opening.

8. The cutting knife as defined in claim 1, wherein said cutting part comprises a tip at its second end.

9. The cutting knife as defined in claim 4, wherein said cutting part comprises a tip at its second end.

* * * * *